United States Patent [19]

Barenburg

[11] Patent Number: 4,919,164

[45] Date of Patent: Apr. 24, 1990

[54] METHOD OF INSTALLING PIPING, DUCTS AND CONDUITS IN A PREFABRICATED FRAMED WALL FOR A BUILDING STRUCTURE AND PARTITION MADE THEREBY

[76] Inventor: Alexander Barenburg, 1305 W. Wolfram St., Chicago, Ill. 60657

[21] Appl. No.: 314,155

[22] Filed: Feb. 23, 1989

[51] Int. Cl.[5] ..... F16L 5/00; E04H 1/00

[52] U.S. Cl. ..... 137/15; 137/360; 137/377; 4/211; 52/79.1; 52/221; 285/45

[58] Field of Search ..... 52/127.1, 220, 221, 52/79.1; 4/211; 137/377, 357, 360, 15, 15, 315; 285/45

[56] References Cited

U.S. PATENT DOCUMENTS

| | | | |
|---|---|---|---|
| 2,037,895 | 4/1936 | Gugler | 137/357 |
| 2,653,357 | 9/1953 | Sanders et al. | 4/211 |
| 2,993,084 | 7/1961 | Curtiss | 285/45 |
| 3,694,973 | 10/1972 | Unger | 52/79.1 |
| 3,766,574 | 10/1973 | Smid, Jr. | 4/191 |
| 3,774,631 | 11/1973 | Willkins | 137/357 |
| 3,978,529 | 9/1976 | Krafft | 4/2 |
| 4,118,854 | 10/1978 | Krafft | 29/428 |
| 4,221,441 | 9/1980 | Bain | 312/228 |
| 4,513,545 | 4/1985 | Hopkins, Jr. | 52/79.1 |
| 4,799,716 | 1/1989 | Kujawa et al. | 285/45 |

*Primary Examiner*—A. Michael Chambers
*Attorney, Agent, or Firm*—Joseph Scafetta, Jr.

[57] ABSTRACT

A method of making a partition for a prefabricated framed wall to be mounted into a building structure under construction has several steps: cutting at least one hole through each of a plurality of frame studs, a top frame plate, and a bottom frame plate; aligning the plurality of frame studs; securing tops of the frame studs to the top frame plate; securing bottoms of the frame studs to the bottom frame plate; installing plumbing pipes between the frame studs; and inserting either a sanitary tee or a waste pipe connector or a heating-/cooling duct through the holes in the bottom frame plate so that they depend therebelow. The sanitary tees connect below a bathroom floor to either a toilet fixture or a bathtub or a shower. The waste pipe connectors are connected below a floor to either a kitchen sink, a dishwasher, a laundry basin, or a clothes washer. The heating/cooling duct connects either below the bathroom floor or above the bathroom ceiling to either a heater or an air conditioner. At least one electrical conduct may be installed between the plurality of frame studs. Removable protective boxes or blocks are secured to an underside of the bottom frame plate so that the partition is ready to be shipped without damage. The partition made by the method includes: a plurality of frame studs having at least one hole cut therethrough; a top frame plate having at least one hole cut therethrough; a bottom frame plate having at least one hole cut therethrough; plumbing pipes installed between the frame studs; and either sanitary tees or waste pipe connectors or heating/cooling ducts inserted through the holes for connection therebelow.

16 Claims, 2 Drawing Sheets

FIG. 2
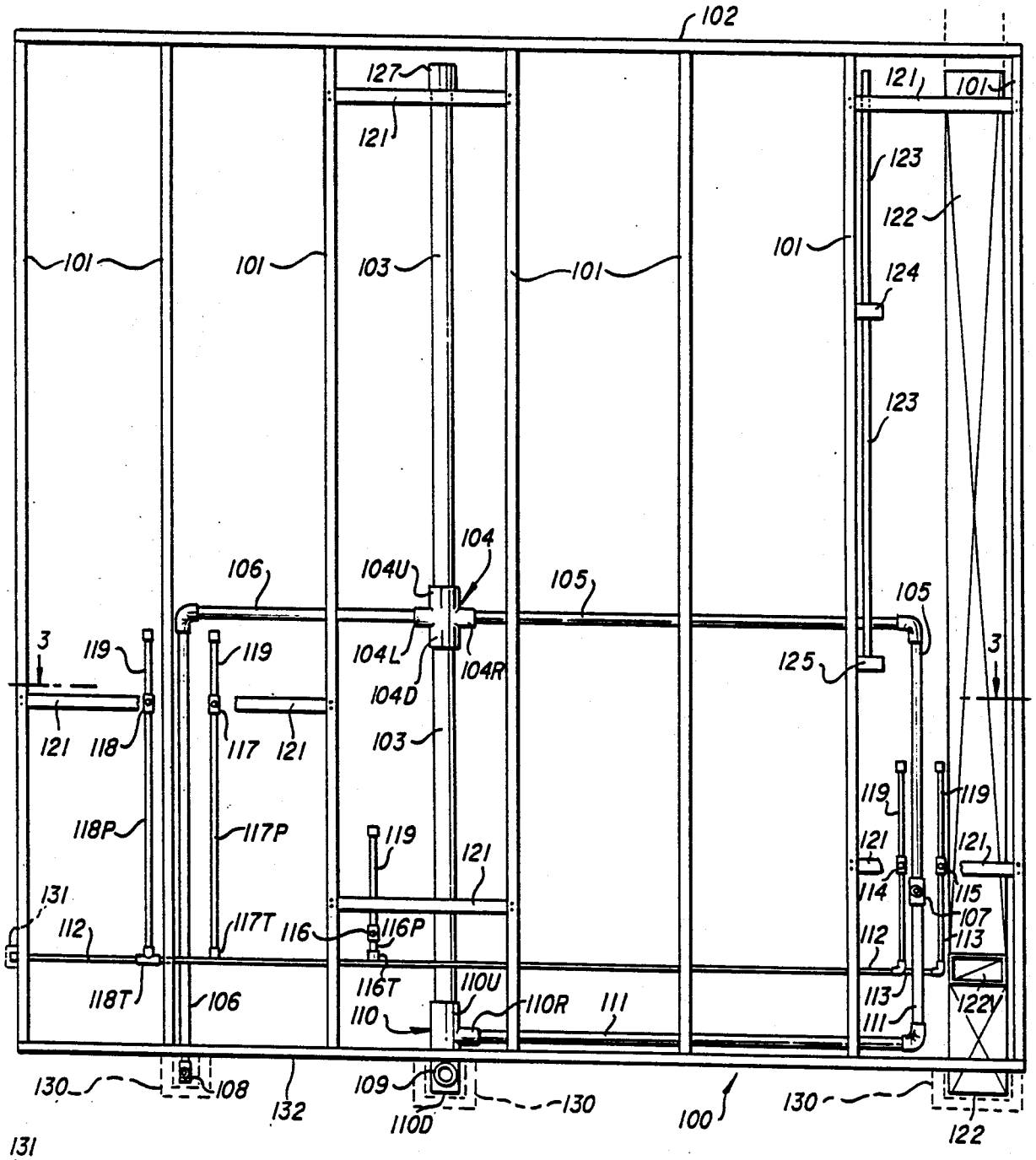
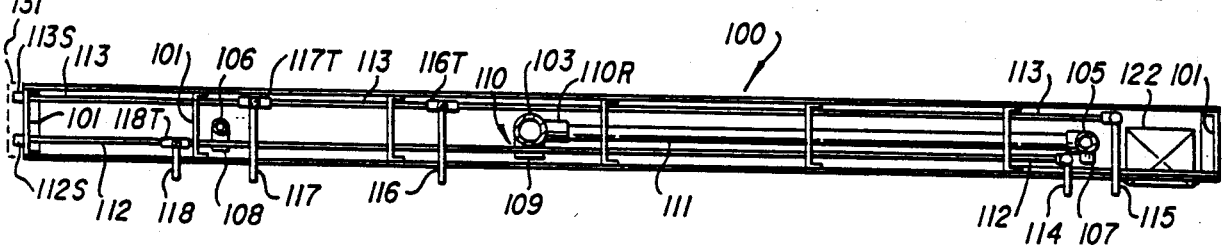
FIG. 3

METHOD OF INSTALLING PIPING, DUCTS AND CONDUITS IN A PREFABRICATED FRAMED WALL FOR A BUILDING STRUCTURE AND PARTITION MADE THEREBY

CROSS-REFERENCE TO RELATED DISCLOSURE

This application is related to Disclosure Document No. 194,704 filed on June 10, 1988.

BACKGROUND OF THE INVENTION

1. Field of the Invention

This invention is a development in the field of buildings generally and, in particular, relates to a method of installing piping, ducts, and conduits in a prefabricated framed wall and to a partition made thereby.

2. Description of the Related Art

Prefabricated wall frameworks and containerized rooms are being used with increasing frequency in the construction of family residences and other buildings. These prefabricated and containerized units are characterized by their flush bases which make the units easy to ship by flatbed trucks and to store on job sites. As units have become larger, rough plumbing has been added directly into the prefabricated wall frameworks and the containerized rooms. As examples thereof, see the teachings in the following prior art references U.S. Pat. No. 3,774,631 issued Nov. 27, 1973, to Willkins; U.S. Pat. No. 3,978,529 issued Sept. 7, 1976, to Krafft; U.S. Pat. No. 4,118,854 issued Oct. 10, 1978, also to Krafft; U.S. Pat. No. 4,221,441 issued Sept. 9, 1980, to Bain; and U.S. Pat. No. 4,513,545 issued Apr. 30, 1985, to Hopkins, Jr. The purposes of such prefabricated and containerized units are generally stated to include increasing the speed of on-site construction and decreasing the need for skilled plumbers on the job.

However, because the plumbing in these units usually does not extend below the flush bases of such units, holes must still be cut or drilled, often by unskilled laborers, into these bases in order to allow for the connection of such plumbing pipes either below the floor or into a wall framework on a lower level. Unfortunately, such unskilled laborers sometimes make mistakes, thus ruining not only the base or the bottom board, but occasionally the entire unit. Such errors are costly and cause construction delays in procuring replacement units. Nevertheless, there is still no known solution for preventing such mistakes.

Furthermore, constant research by developers, contractors, and others in the housing industry has not yet made any substantial improvement, other than the inclusion of rough plumbing, in prefabricated wall frameworks and containerized rooms during the 1970's and 1980's.

SUMMARY OF THE INVENTION

A partition made by a method of installing piping in a framed wall includes, in addition to rough plumbing, electrical conduits and large ducts for heating and cooling the building being constructed. The framed wall partition made by the installation method has its rough plumbing pipes, its electrical conduits, its heating/cooling ducts, and any other type of connections extending below its bottom frame plate so that unskilled or semiskilled laborers can quickly and easily connect such pipes, conduits, and ducts either below the floor or directly into the framed wallwork on the lower level without the need for cutting the base or the bottom frame plate.

It is a primary object of the present invention to provide a framed wallwork which is a substantial improvement over the prior art arrangements by prefabricating electrical conduits, heating/cooling ducts, and other types of connections, in addition to rough plumbing pipes, directly into such wallwork. Such other types of connections include, but are not limited to, vacuum lines, telephone wires, intercom circuits, and the like.

It is a secondary object of the present invention to provide a more sophisticated and intricate framed wallwork which will reduce the high labor cost of skilled electricians and installers of heating/cooling systems, yet which is capable of being connected to upper and lower level wallwork by less expensive unskilled and semiskilled laborers.

It is a tertiary object of the present invention to prevent the ruination of entire prefabricated wallworks caused by errors made by unskilled employees when cutting either the top or the bottom frame plate of such prefabricated wallworks by providing framed wallworks that already have plumbing pipes, electrical conduits, and heating/cooling ducts extending through the bottom frame plate, thus obviating the need for such cutting steps by unskilled laborers.

It is another object of the present invention to increase the efficiency and the speed at which residences and other buildings are constructed on job sites.

It is a further object of the present invention to provide a method and a means for shipping prefabricated wall frameworks and containerized rooms with pipes, conduits, and ducts extending through the top or the bottom frame plate thereof without causing damage to such wall and room units.

It is a still further object of the present invention to provide a partition that may be incorporated into a variety of floor plans, thus permitting flexibility in design choices for multistory buildings.

These and other objects of the present invention will become readily apparent from the following brief description of the drawings and the subsequent detailed description of the preferred embodiment.

BRIEF DESCRIPTION OF THE DRAWINGS

FIG. 2 is a front elevational view of the present invention which is a prefabricated framed wallwork incorporating plumbing pipes, electrical conduits, and heating/cooling ducts extending through the top or bottom frame plate.

FIG. 3 is a cross-sectional view of the present invention taken along line 3—3 in FIG. 2.

DETAILED DESCRIPTION OF THE PREFERRED EMBODIMENT

Figure 1:
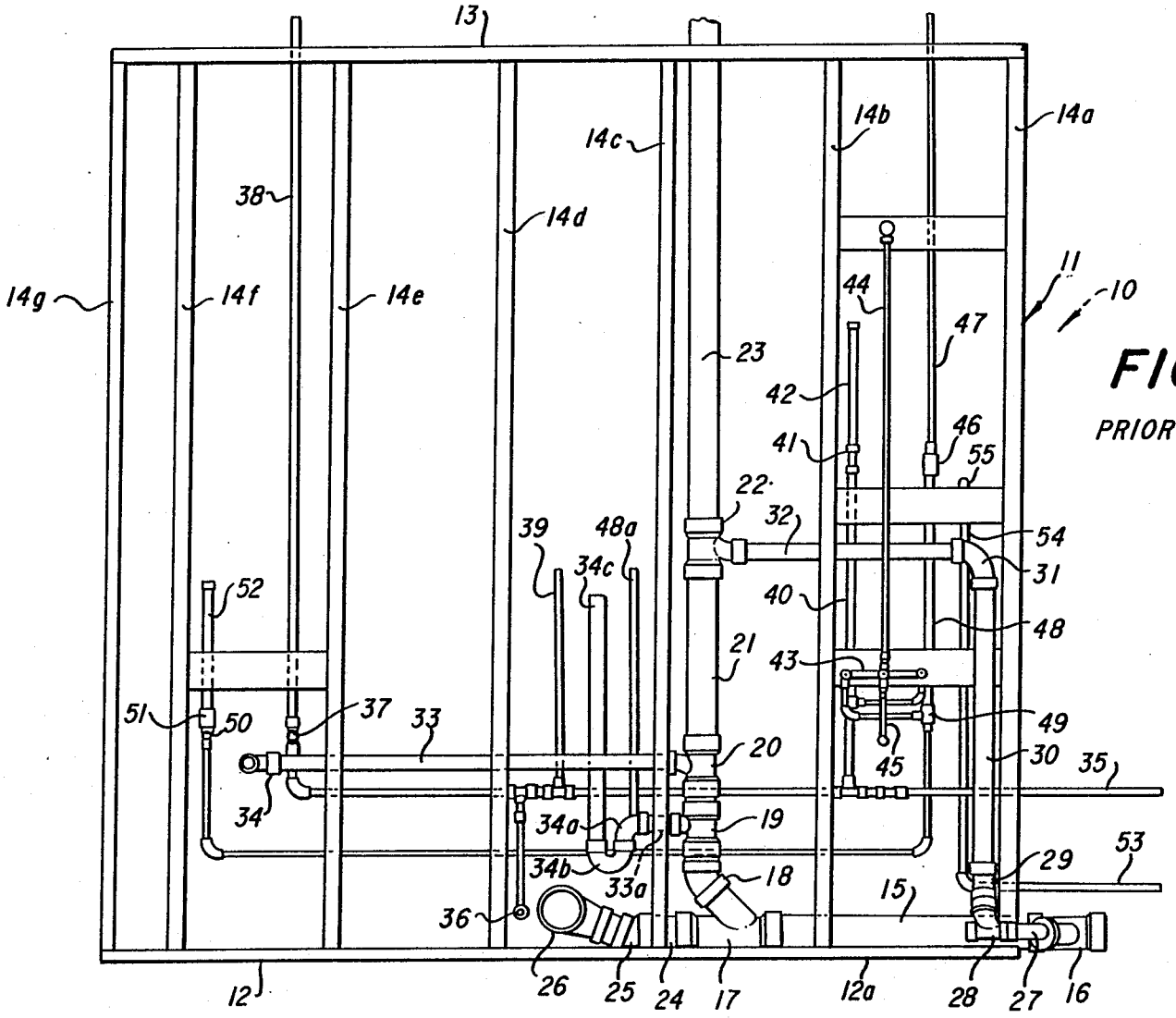
FIG. 1 PRIOR ART
FIG. 1 is a front elevational view of a prefabricated framed wallwork known in the prior art and incorporating rough plumbing therein.

Referring first in detail to a known prior art arrangement of one Willkins mentioned above, FIG. 1 shows, generally, a prefabricated modular rough plumbing unit 10 for back-to-back plumbing installation directly upon a building slab during framing of the building. The plumbing unit 10 comprises a wall framework 11, preferably of 2×6 lumber, including a bottom plate 12, a top plate 13 and vertical studs 14*a* through 14*f*. The studs 14*a* through 14*f*, which include between them all the necessary rough plumbing, are spaced 16 inches on centers, in accordance with usual building code requirements. If the full length of the wall required in the building in which the plumbing unit 10 is installed is only slightly longer than the length afforded by the six studs 14*a* through 14*f*, such full length is provided for by extending the lengths of the bottom 12 and top 13 by the required amount and by adding an additional end stud 14*g*. The overall height of the plumbing unit 10 is the full height of the partition required in the building under construction. It is understood, however, that the wall framework 11 could be shortened to the extent permitted by the interior plumbing to facilitate storage and transportation of the modular units. In such instances, it is necessary for the carpenter, upon installation of the rough plumbing unit, to continue the stud work to the required room height.

The modular unit 10 is designed for back-to-back plumbing installation accommodating a bathroom tub and shower water closet and lavatory at one side of the wall, and a kitchen and water heater or clothes washer and water heater at the other side of the wall.

As illustrated in FIG. 1, the modular unit 10 of the prior art comprises a short length of soil pipe 15 resting upon the bottom plate 12 at one end thereof and extending through openings at the lower ends of the vertical studs 14*a* and 14*b*. One end of the soil pipe 15 extends through the outer stud 14*a*, whereat it is joined to a 45° Y-branch 16 extending in the horizontal direction. The inner end of the soil pipe 15 is joined to a 45° Y-branch 17, the branch arm of which is directed upwardly. The upper end of the Y-branch 17 is joined to a 45° elbow or bend 18 extending upwardly between the wall framework studs 14*b* and 14*c*. The 45° bend 18 connects in vertical succession with a first sanitary top tee 19, a second sanitary top tee 20, a length of vent stack pipe 21, a sanitary tee 22, and a length of pipe 23, thus continuing the vent stack through an opening in the top plate 13. The inward, horizontally extending portion of the 45° Y-branch 17 connects with a short length of horizontal soil pipe 24 terminating in a 1/16-inch bend 25, the outer end of which is connected with a closet bend 26 extending horizontally outward at one side of the wall framework 11 in a vertically spaced relationship above the bottom plate 12.

The branch portion of the 45° Y-branch 16, which extends horizontally outwardly of the same side of the wall framework 11 as the closet bend 26, joins with a horizontally disposed ⅛-inch bend 27. The outer end of the ⅛-inch bend 27 is joined with a sanitary tee 28, the branch portion of which extends upwardly and inwardly at an angle of approximately 45° with respect to the vertical wall framework 11. The outer end of the branch portion of the sanitary tee 28 joins with a vertically and upwardly extending ⅛-inch bend 29 between the wall framework studs 14*a* and 14*b*. The ⅛-inch bend 29 connects with a vertical vent pipe 30 terminating in a 90° bend or elbow 31 directed inwardly towards the vent stack pipe 23 and joined therewith through a horizontal vent pipe 32 connected with the branch portion of the sanitary tee 22.

A slightly pitched, substantially horizontal waste pipe 33 extending through openings in the vertical studs 14*c*, 14*d*, and 14*e* is joined at one end with the waste branch portion of the sanitary tap tee 20 and connects at its outer end with a 90° bend 34 extending outwardly of the wall framework 11 at the same side as the closet bend 26.

A short length of horizontally extending waste pipe 33*a* extending through the wall framework stud 14*c* connects at one end with the waste branch portion of the sanitary top tee 19 and connects at its outer end with a downwardly directed elbow 34*a*. The outer end of the elbow 34*a* joins with a U-bend 34*b* which, together with the elbow 34*a*, provides a P-trap for a vertical length of drain pipe 34*c* to accommodate a washing machine installation at that side of the wall framework 11 opposite the closet bend 26. Alternatively, the drain pipe 34*c* is used as a waste connection for a kitchen sink. The drain and waste piping described above is preferably assembled with use of synthetic plastic components, such as polyvinyl chloride, otherwise known as PVC piping, because of its sturdy construction and its lightness in weight. It is to be noted, however, that copper pipe or other piping is used wherever required or preferred.

In the assembly of the above-described prior art piping, it is understood that the drain line is slightly pitched in such a direction so as to insure drainage into the vertical stack and outwardly through the horizontal soil pipe 15 into the 45° Y-branch 16. The sanitary tee 28 is directed sidewardly and outwardly of the wall framework 11 as a waste connection for a bathtub. It is, therefore, kept as low as possible to permit installation of any ordinary bathtub at slab level. To this end, the bottom plate 12 is preferably in the form of a thin, bent metal channel plate having upstanding sidewall portions 12*a* and 12*b* upon which such piping can rest and be secured in place by the wall framework studs 14*a*, 14*b* and 14*c*.

The piping, including the vent pipes 32 and 30 connecting the sanitary tee 28 and the vent stack pipe 23, provide back venting for the bathtub upon its installation in accordance with plumbing code requirements, thus insuring free bathtub drainage. That portion of the above-described waste system extending outwardly of the end stud 14*a*, more particularly the 45° Y-branch 16 and a portion of its associated ⅛-inch bend 27, is adapted to extend through an outside wall of the building in which the modular unit 10 is installed. Thus, upon installation, a suitable side wall opening is provided for the 45° Y-branch 16 for connection to an outside clean-out fitting and/or the sewer line. Thus, in installation, the outer vertical stud 14*a* of the unit wall framework is adapted to be secured against an inside wall portion in the building under construction in the same manner as one would secure in place wall studding in ordinary house construction. It is thus understood that the carpenter, during the interior framing of the house, will be able to install the modular unit 10 in place in accordance with the plans without the aid of an on-the-job plumber.

In addition to the above-described waste piping, the modular unit 10 will also include within its framework hot and cold water supply piping stubbed out for subsequent connection with plumbing fixtures, a hot water heater, etc. To this end, a cold water supply pipe 35 extends horizontally through all framework studs 14*a*, 14*b*, 14*c*, 14*d* and 14*e* for connection with a sidewardly and outwardly extending water closet stub pipe 36, a cold water bathroom lavatory stub 37, and a vertical cold water line or riser 38 for use in multistory construction. The cold water supply pipe 35 also connects with a utility cold water stub-out pipe 39 for supplying water to a clothes washer, or a kitchen sink, for example, and with a vertical cold water pipe 40 having a T-fitting 41 at its upper end extending into an antiwater-hammer air chamber 42. The T-fitting 41 joins with a sidewardly and outwardly extending cold water stub (not illustrated) for supplying water to a hot water heater. The vertical cold water pipe 40 also connects with the cold water side of a diverter 43 connecting with a shower riser 44 and a tub faucet stub 45. A T-fitting 46 located in laterally spaced relationship with respect to the T-fitting 41 between the vertical studs 14*a* and 14*b* is connected with an upwardly extending hot water riser 47 for use in multistory construction and in residences where a hot water connection to remote fixtures is to be made through the ceiling. The T-fitting 46 is stubbed out for subsequent connection with the hot water outlet of a water heater and joins with a downwardly extending hot water pipe 48. The hot water pipe 48 connects through T-fitting 49 to the hot water side of the diverter fitting 43 and passes laterally through wall studs 14*b*, 14*c*, 14*d* and 14*e* for connection with utility area hot water stub-out pipe 48*a* and bathroom lavatory stub 50. The stub 50 extends sidewardly and outwardly of a T-fitting 51, the upper end of which joins with an antiwater-hammer air chamber 52. A hot water relief pipe 35, extending upwardly through vertical pipe 54 to terminate in the sidewardly and outwardly extending stub 55, is provided for connection with the pressure relief valve of a hot water heater upon its subsequent installation.

While cold and hot water riser pipes 38 and 47 are illustrated in FIG. 1 and described herein, it is understood that these pipes 38 and 47 are supplied only for connection with identical or similar modular plumbing units aligned vertically above in multistory building construction and in residences where an overhead supply connection and/or a remote fixture connection is made through the ceiling joists.

Referring now in detail to the present invention, FIGS. 2 and 3 show generally a partition 100, preferably made of 2×6 inch metal channels, including vertical frame studs 101 screwed or welded at their tops to a horizontal frame plate 102 and also screwed or welded at their bottoms to a horizontal base or bottom frame plate 132 to form a rectangular framed wall section for joining to an adjacent rectangular framed wall section (not shown) in order to construct a framed wallwork, in this particular case, for a bathroom.

Within the partition 100, there is a cross-piece 104 having a waste vent stack 103 extending vertically from an upper arm 104U to a collar 127 that connects to an upper floor level. The cross-piece 104 also has a right arm 104R that receives a lavatory vent 105 extending horizontally and upwardly from a sanitary tee 107 for connection to a lavatory (not shown). A left arm 102L receives a bath vent 106 that extends horizontally and upwardly from a sanitary tee 108 positioned below a bathroom floor (not shown) for connection to either a bathtub or a shower (also not shown). It is to be noted that the bath vent 106 extends through the base or bottom frame plate 132 so that the bath sanitary tee 108 depends therebelow. From a downwardly extending arm 104D of the cross-piece 104, the waste vent stack 103 connects vertically to an upper arm 110U of a sanitary tee 110. A right arm 110R of the sanitary tee 110 receives one end of a lavatory waste pipe 111 that is joined at its other end to the lavatory sanitary tee 107. To a downwardly extending arm 110D of the sanitary tee 110, there is connected another sanitary tee 109 that is joined to a bent connection for a toilet fixture (not shown). Note that the arm 110D extends through the frame plate 132 so that the sanitary tee 109 depends therebelow for connection to the toilet fixture.

The dependence of the bath sanitary tee 108 and the water closet sanitary tee 109 below the base or bottom frame plate 132 of the partition 100 is a key feature of the present invention that, consequently, allows the partition 100 to be used in standard housing construction because the partition 100 is installed flush at any floor level without additional installation steps being required.

Framed wallwork s used in conventional prefabricated housing construction have both the bath sanitary tee and the water closet sanitary tee arranged within the partition and slightly above the bottom board or lowest plate so that a special raised bath and water closet must be installed. Such so-called "throne" arrangements, which require users to take at least one step up onto an elevated portion of the bathroom where the bathtub/-shower and water closet are located, are generally disliked by elderly persons, the handicapped, and families with very young children.

In order to facilitate the shipment of the partition 100 of the present invention, protective boxes 130, longer than the sanitary tees 108 and 109, are secured to the underside of the bottom frame plate 132 at the manufacturing plant where the framed wall sections are assembled.

After unloading the partitions 100, with the protective boxes 130 depending therefrom, off the truck or trailer on which the partitions 100 arrived, unskilled workers can easily knock off the depending boxes 130 with hammers when such partitions 100 are ready for use on the job site. Thus, the depending tees 108 and 109 are protected from damage in transit and the bottom frame plate 132 of the partition 100 need not be either cut or drilled by unskilled workers in order to connect such tees 108 and 109 to either the bathtub or the shower and the toilet fixture, respectively. Alternatively, each partition 100 may be shipped upside down with the top frame plate 102 laid on the flatbed of the truck or trailer because there are no protrusions of piping and the like above the top frame plate 102. Thus, the removable protective boxes 130 are not necessary when the partitions 100 are shipped upside down.

Returning to a discussion of the plumbing pipes confined within the framework of the partition 100, it is best shown in FIG. 3 that a hot water line 112 and a cold water line 113 may enter through the most leftward frame stud 101 via sleeves 112S and 113S, respectively, and extend almost all the way to the most rightward frame stud 101. These sleeves 112S and 113S may be protected in transit by a protective box 131.

At preselected locations, the water lines 112 and 113 turn upwardly, as best shown in FIG. 2, and are connected to a lavatory hot water stub 114 and to a lavatory cold water stub 115, respectively. Above each stub 114 and 115, there is arranged an antiwater hammer air chamber 119.

Referring again to the most leftward frame stud 101, when particular attention is paid to FIG. 3, it may be seen that the hot water line 112 is more forward than and, thus, blocks the view of the cold water line 113 in FIG. 2. So as to avoid confusion, reference is made first to FIG. 3, wherein a pipe tee 116T in the cold water line 113 is shown. However, as shown in FIG. 2, the pipe tee 116T is partially obscured behind the more forward hot water line 112. Nevertheless, from a visible upper branch of the pipe tee 116T, a short pipe section 116P extends to join with a cold water stub 116 for the toilet fixture (not shown). Above the cold water stub 116, there is another antiwater-hammer air chamber 119. Likewise, farther along the cold water line 113, shown straddling the second most leftward frame stud 101 in FIG. 3, there is another pipe tee 117T. As seen in FIG. 2, from a visible upper branch of the partially obscured pipe tee 117T, a cold pipe section 117P extends upwardly to a cold water stub 117 for either the bathtub or the shower (not shown). Again, above the stub 117, there is an antiwater-hammer air chamber 119. Referring back to FIG. 3, it is seen that the hot water line 112 has a complementary bathtub/shower pipe tee 118T which is clearly shown and not obscured in FIG. 2. From an upper branch of the pipe tee 118T, a hot pipe section 118P extends to a hot water stub 118 for either the bathtub or the shower (not shown). Above this stub 118, there is also an antiwater-hammer air chamber 119. As it may be surmized, the height of the stubs 117 and 118 above the bottom board 132 will be selected, depending upon whether either a bathtub or a shower is to be installed. From FIG. 2, it may also be surmized that, since the stubs 117 and 118 are above the lavatory stubs 114 and 115, this particular partition 100 is intended for installation into a bathroom with a shower. If a bathtub were intended to be installed instead of a shower, the stubs 117 and 118 would be lower in height than the height of the stubs 114 and 115 for the lavatory. To facilitate viewing of the stubs 114, 115, 117, and 118, three cross-braces 121, which support the respective pipes 112, 113, 117P, and 118P leading to the stubs just enumerated, are broken away. Two other cross-braces 121 supporting the vent stack 103 near the top plate 102 and also near the bottom board 132 have not been broken away.

For conventional prefabricated wallworks, the discussion would end here because there are only plumbing pipes fixed into such framed walls.

However, in the present invention, as best shown in FIG. 2, there is also at least one duct 122 through which either hot air from a heater (not shown) or cold air from an air conditioner (also not shown) flows. The heater and the air conditioner may be parts of a central air circulating system that is situated in the basement. Air is pumped by the system up the duct 122 and part of such air enters the bathroom through an outlet vent 122V. The remainder of such air passes upwardly through the duct 122 to an upper level above the top frame plate 102. Another cross-brace 121 supports the duct 122 near its top where the duct 122 may be joined to another duct 122, shown in dashed lines, extending above the top frame plate 102.

Furthermore, as shown only in FIG. 2, the present invention also includes at least one electrical conduit 123 that runs down from the top frame plate 102 through the cross-brace 121 along the second most rightward frame stud 101. A first junction box 124 is secured to the frame stud 101 and supplies electrical power to a wall lighting fixture (not shown). The electrical conduit 123 terminates in a second junction box 125 that is also fastened to the frame stud 101 and supplies electrical power to a wall receptacle (not shown) positioned above the lavatory.

Now that the various parts that comprise the partition 100 have been described, a detailed discussion will be made about the method of the present invention.

The method of making the partition 100 for a prefabricated framed wall to be mounted into a building structure under construction comprises several steps.

Initially, in the manufacturing plant, a worker punches preferably three holes in a number of identical metal channels. He then aligns some of the punched channels as a plurality of frame studs 101 on a working surface, such as a floor, so that they will be oriented vertically and substantially parallel to each other when the framed wall is assembled and mounted upright into the building structure. First, the tops of the plurality of aligned frame studs 101, which number seven in FIGS. 2 and 3, are secured by screwing or welding them to another punched channel that serves as the top frame plate 102 which will be horizontally oriented when the framed wall is completed and turned upright. In a similar manner, the bottoms of the plurality of aligned frame studs 101 are fastened by screwing or welding them to a different punched channel that serves as the bottom frame plate 132 which will be oriented horizontally and substantially parallel to the top frame plate 102 when the framed wall is finished. Alternately, the bottoms of the frame studs 101 may be secured to the bottom frame plate 132 first and then the tops of the frame studs 101 may be secured to the top frame plate 102.

Next, the various plumbing pipes 103-119 are installed by workers at the manufacturing plant in any convenient manner through the holes punched in the channels that serve as the plurality of frame studs 101, the top frame plate 102, and the bottom frame plate 132. Also, at least one duct 122 for heating and/or cooling air is installed therebetween. Likewise, at least one electrical conduit 123 is installed therebetween by the workers at the plant. Although it is preferable to install the plumbing pipes first, followed by the heating/cooling duct 122 and finally the electrical conduit 123, the installer may actually secure the plumbing pipes, the duct 122, and the electrical conduit 123 in any convenient order.

Through one such hole cut in the bottom frame plates 132, the sanitary tee 108, best seen in FIG. 2, is inserted so that the sanitary tee 108 depends below the bottom frame plate 132. Since it can be seen that the sanitary tee 108 leads to the bath vent 106, it may be surmized that this sanitary tee 108 is intended for eventual connection on a job site to either a bathtub or a shower (not shown) at a point below the bathroom floor.

Through another such hole cut in the bottom frame plate 132, the sanitary tee 109, best seen in FIG. 2, is also inserted so that the sanitary tee 109 depends below the bottom frame plate 132. Since the sanitary tee 109 leads to the waste vent stack 103, this sanitary tee 109 is intended for eventual connection on a job site to the toilet fixture (not shown) at a point below the bathroom floor.

Through the third such hole cut in the bottom frame plate 132, the duct 122 for heating and/or cooling air, best seen in FIG. 2, is inserted so that the duct 122 depends below the bottom frame plate 132. Since the duct 122 leads to the bathroom outlet vent 122V and then to another vent (not shown) on an upper level, such duct 122 is intended for eventual connection on a job site to either a heater or an air conditioner or a combined air conditioner/heater (not shown) at a point below the bathroom floor, preferably in the basement of the building under construction.

Following the insertion of the first sanitary tee 108, the second sanitary tee 109, and the duct 122 into the holes cut vertically through the bottom frame plate 132, an optional step of the method may include covering at least one side and possibly both sides of the partition 100 with dry wall boards or other suitable surfacing means.

Although the partition 100 has been discussed in relation to its use as a prefabricated framed wall in a bathroom, the partition 100 may also be used in either a kitchen or a laundry room. If the partition 100 is used in either a kitchen or a laundry room, then the sanitary tees 108 and 109 function as waste pipe connectors in FIGS. 2 and 3. In both cases, the waste pipe connectors 108 and 109 depend below a floor in either a kitchen or a laundry room for connection to either a kitchen sink, a dishwasher, a laundry basin, or a clothes washer (not shown).

Finally, the protective boxes 130, shown in dashed lines in FIG. 2, are secured by any suitable fastening means to an underside of the bottom frame plate 132. In lieu of such boxes 130, a pair of removable blocks may be placed adjacent to each tee and duct to be protected.

At the conclusion of this step, the partition 100 is ready to be shipped without damage to either the first sanitary tee 108 or the second sanitary tee 109 or the duct 122, all of which hang below the bottom frame plate 132, because the protective boxes 130 are secured over the first sanitary tee 108, the second sanitary tee 109, and the duct 122 so that such tees and ducts do not contact the flatbed of the trailer on which such partitions 100 are being shipped.

If the manufacturing process does not include the final step of securing either the removable blocks or the protective boxes 130 on the underside of the bottom frame plate 132, then the partitions 100 are shipped either upside down on the top frame plate 102 or on their right sides with the most rightward frame stud 101 on the bottom, so that either the flat top frame plate 102 or the frame stud 101 contact the flatbed of the trailer. The partitions 101 are never shipped on their left sides with the most leftward frame stud 101 on the bottom, because it is desired to avoid damage to the protective box 131 covering the sleeves 112S and 113S, best shown in FIG. 3, that protrude from the most leftward frame stud 101.

The foregoing preferred embodiment is considered illustrative only. Numerous other modifications will readily occur to those persons skilled in the building industry after reading the foregoing disclosure. Consequently, the disclosed invention is not limited by the exact construction and manufacturing process shown and described above, but rather it is defined by the claims appended hereto.

What I claim as my invention is:

1. A method of making a partition for a prefabricated framed wall to be mounted into a building structure under construction, said method comprising the steps of:

a. cutting at least one hole through each of a plurality of frame studs, a top frame plate, and a bottom frame plate;

b. aligning the plurality of frame studs to be oriented vertically and substantially parallel to each other;

c. securing tops of the plurality of frame studs to the top frame plate to be oriented horizontally;

d. securing bottoms of the plurality of frame studs to the bottom frame plate to be oriented substantially parallel to the top frame plate;

e. installing plumbing pipes between the plurality of frame studs, the top frame plate, and the bottom frame plate;

f. inserting a sanitary tee of the plumbing pipes through at least one hole cut in the bottom frame plate so that the sanitary tee depends therebelow for connection below a bathroom floor to one of a bathtub, a shower, and a toilet fixture; and g. securing a removable box means for protecting the sanitary tee on an underside of the bottom frame plate so that the partition is ready to be shipped without damage to the sanitary tee depending below the bottom frame plate;

whereby a partition is made for a prefabricated framed wall to be mounted into a building structure under construction.

2. The method according to claim 1, further comprising the step of:

h. installing at least one duct means for heating and/or cooling air between the plurality of frame studs, the top frame plate, and the bottom frame plate.

3. The method according to claim 1, further comprising the step of:

h. installing at least one electrical conduit between the plurality of frame studs, the top frame plate, and the bottom frame plate.

4. A method of making a partition for a prefabricated framed wall to be mounted into a building structure under construction, said method comprising the steps of:

a. cutting at least one hole through each of a plurality of frame studs, a top frame plate, and a bottom frame plate;

b. aligning the plurality of frame studs to be oriented vertically and substantially parallel to each other;

c. securing tops of the plurality of frame studs to the top frame plate to be oriented horizontally;

d. securing bottoms of the plurality of frame studs to the bottom frame plate to be oriented substantially parallel to the top frame plate;

e. installing plumbing pipes between the plurality of frame studs, the top frame plate, and the bottom frame;

f. inserting a waste pipe connector of the plumbing pipes through at least one hole cut in the bottom frame plate so that the waste pipe depends therebelow for connection below a floor to one of a kitchen sink, a dishwasher, a laundry basin, and a clothes washer; and g. securing a removable box means for protecting the waste pipe on an underside of the bottom frame plate so that the partition is ready to be shipped without damage to the waste pipe depending below the bottom frame plate.

whereby a partition is made for a prefabricated framed wall to be mounted into a building structure under construction.

5. The method according to claim 4, further comprising the step of:

h. installing at least one duct means for heating and/or cooling air between the plurality of frame studs, the top frame plate, and the bottom frame plate.

6. The method according to claim 4, further comprising the step of:

h. installing at least one electrical conduit between the plurality of frame studs, the top frame plate, and the bottom frame plate.

7. A method of making a partition for a prefabricated framed wall to be mounted into a building structure under construction, said method comprising the steps of:

a. cutting at least one hole through each of a plurality of frame studs, a top frame plate, and a bottom frame plate;

b. aligning the plurality of frame studs to be oriented vertically and substantially parallel to each other;

c. securing tops of the plurality of frame studs to the top frame plate to be oriented horizontally;

d. securing bottoms of the plurality of frame studs to the bottom frame plate to be oriented substantially parallel to the top frame plate;

e. installing plumbing pipes between the plurality of frame studs, the top frame plate, and the bottom frame plate;

f. inserting at least one duct means for heating and/or cooling air between the plurality of frame studs through at least one hole cut in one of the bottom frame plate and the top frame plate so that the duct extends for connection either below a bathroom floor or above a bathroom ceiling, respectively, to one of a heater and an air conditioner; and g. securing a removable box means for protecting the duct means on one of the bottom frame plate and the top frame plate;

whereby the partition is ready to be shipped without damage to the duct means.

8. The method according to claim 7, further comprising the step of:

h. installing at least one electrical conduit between the plurality of frame studs, the top frame plate, and the bottom frame plate.

9. A partition made for a prefabricated framed wall to be mounted into a building structure under construction, said partition comprising:

a. a plurality of frame studs having at least one hole cut therethrough and being oriented vertically and substantially parallel to each other;

b. a top frame plate having at least one hole cut therethrough and being horizontally oriented, said top frame plate being secured to tops of the plurality of frame studs;

c. a bottom frame plate having at least one hole cut therethrough and being horizontally oriented parallel to the top frame plate, said bottom frame plate being secured to bottoms of the plurality of frame studs;

d. plumbing pipes installed between the plurality of frame studs, the top frame plate, and the bottom frame plate;

e. a sanitary tee means, attached at one end to the plumbing pipes and inserted through at least one hole cut in the bottom frame plate to depend below the bottom frame plate, for connecting below a bathroom floor to one of a bathtub, a shower, and a toilet fixture; and f. removable protective box means, secured to an underside of the bottom frame plate, for allowing the partition to be shipped without damage to the sanitary tee means depending below the bottom frame plate.

10. The partition according to claim 9, further comprising:

g. at least one duct means for heating and/or cooling air, said duct means being installed between the plurality of frame studs, the top frame plate, and the bottom frame plate.

11. The partition according to claim 9, further comprising:

g. at least one electrical conduit installed between the plurality of frame studs, the top frame plate, and the bottom frame plate.

12. A partition made for a prefabricated framed wall to be mounted into a building structure under construction, said partition comprising:

a. plurality of frame studs having a least one hole cut therethrough and being oriented vertically and substantially parallel to each other;

b. a top frame plate having at least one hole cut therethrough and being horizontally oriented, said top frame plate being secured to tops of the plurality of frame studs;

c. a bottom frame plate having at least one hole cut therethrough and being horizontally oriented parallel to the top frame plate, said bottom frame plate being secured to bottoms of the plurality of frame studs;

d. plumbing pipes installed between the plurality of frame studs, the top frame plate, and the bottom frame plate;

e. a waste pipe means, attached at one end to the plumbing pipes and inserted through at least one hole cut in the bottom frame plate to depend below the bottom frame plate, for connecting below a floor to one of a kitchen sink, and a dishwasher, a laundry basin, and a clothes washer; and f. removable protective box means, secured to an underside of the bottom frame plate, for allowing the partition to be shipped without damage to the waste pipe means depending below the bottom frame plate.

13. The partition according to claim 12, further comprising:

g. at least one duct means for heating and/or cooling air, said duct means being installed between the plurality of frame studs, the top frame plate, and the bottom frame plate.

14. The partition according to claim 12, further comprising:

g. at least one electrical conduit installed between the plurality of frame studs, the top frame plate, and the bottom frame plate.

15. A partition made for a prefabricated framed wall to be mounted into a building structure under construction, said partition comprising:

a. a plurality of frame studs having at least one hole cut therethrough and being oriented vertically and substantially parallel to each other;

b. a top frame plate having at least one hole cut therethrough and being horizontally oriented, said top frame plate being secured to tops of the plurality of frame studs;

c. a bottom frame plate having at least one hole cut therethrough and being horizontally oriented parallel to the top frame plate, said bottom frame plate being secured to bottoms of the plurality of frame studs;

d. plumbing pipes installed between the plurality of frame studs, the top frame plate, and the bottom frame plate;

e. a duct means for heating and/or cooling air, said duct means being arranged between the plurality of frame studs and being inserted through at least one hole cut in one of the bottom frame plate and the top frame plate so that the duct means extends for connection either below a bathroom floor or above a bathroom ceiling, respectively, to one of a heater and an air conditioner; and f. removable protective box means, secured to an underside of the bottom frame plate, for allowing the partition to be shipped without damage to the duct means depending below the bottom frame plate.

16. The partition according to claim 15, further comprising:

g. at least one electrical conduit installed between the plurality of frame studs, the top frame plate, and the bottom frame plate.

* * * * *

UNITED STATES PATENT AND TRADEMARK OFFICE

CERTIFICATE OF CORRECTION

PATENT NO. : 4,919,164

DATED : April 24, 1990

INVENTOR(S) : Alexander Barenburg

It is certified that error appears in the above-identified patent and that said Letters Patent is hereby corrected as shown below:

TITLE PAGE,
Abstract, left col., line 18, change "conduct" to --conduit--.

Col. 1, line 28, after "references", insert --:--.

Col. 5, line 23, change "35" to --53--; and line 52, change "102L" to --104L--.

Col. 6, line 11, change "wallwork s" to --wallworks--.

Col. 8, line 40, change "plates" to --plate--.

Col. 10, claim 4, line 41, after "frame" but before ";", insert --plate--; and claim 4, line 52, change "." to --;--.

Col. 12, claim 12, line 28, delete "and".

Signed and Sealed this

Fourteenth Day of May, 1991

*Attest:*

HARRY F. MANBECK, JR.

*Attesting Officer*

*Commissioner of Patents and Trademarks*